US011567434B1

(12) United States Patent
Okuyama

(10) Patent No.: US 11,567,434 B1
(45) Date of Patent: Jan. 31, 2023

(54) IMAGE FORMING APPARATUS CAPABLE OF CORRECTION OF POSITIONAL DISPLACEMENT BETWEEN AN IMAGE AND A MEDIUM

(71) Applicant: FUJIFILM Business Innovation Corp., Tokyo (JP)

(72) Inventor: Shinji Okuyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/544,911

(22) Filed: Dec. 7, 2021

(30) Foreign Application Priority Data

Aug. 25, 2021 (JP) ..... JP2021-137191

(51) Int. Cl.
*G03G 15/01* (2006.01)
*G03G 15/16* (2006.01)
*G03G 21/20* (2006.01)

(52) U.S. Cl.
CPC ..... *G03G 15/1615* (2013.01); *G03G 21/203* (2013.01)

(58) Field of Classification Search
CPC ..... G03G 15/1605; G03G 15/1615; G03G 15/1655; G03G 21/203
USPC ..... 399/44, 302–304, 312
See application file for complete search history.

(56) References Cited

U.S. PATENT DOCUMENTS 8,639,136 B2 * 1/2014 Tomura et al. .... G03G 15/1605 399/40
10,289,036 B2 * 5/2019 Yokoyama et al. ..... G03G 15/1615
2020/0190343 A1 6/2020 Izawa et al.

FOREIGN PATENT DOCUMENTS

JP 2000127359 5/2000
JP 2012141396 7/2012
JP 2020097239 6/2020
JP 2020097643 6/2020

* cited by examiner

*Primary Examiner* — William J Royer
(74) *Attorney, Agent, or Firm* — JCIPRNET

(57) ABSTRACT

An image forming apparatus includes an image carrier that is capable of holding an image on a surface thereof while rotating, an image forming unit that forms the image on the image carrier, a transfer unit that transfers the image from the image carrier to a medium while rotating, a transport unit that circulates as the transfer unit rotates and that transports the medium to a transfer region while holding the medium, and a control unit that changes a timing at which the image forming unit forms the image in accordance with variation in a ratio of a rotation velocity of the transfer unit to a rotation velocity of the image carrier.

20 Claims, 7 Drawing Sheets

IMAGE FORMING APPARATUS CAPABLE OF CORRECTION OF POSITIONAL DISPLACEMENT BETWEEN AN IMAGE AND A MEDIUM

CROSS-REFERENCE TO RELATED APPLICATIONS

This application is based on and claims priority under 35 USC 119 from Japanese Patent Application No. 2021-137191 filed Aug. 25, 2021.

BACKGROUND

(i) Technical Field

The present disclosure relates to an image forming apparatus.

(ii) Related Art

Regarding image forming apparatuses, a technology described in Japanese Unexamined Patent Application Publication No. 2012-141396 (paragraphs [0031] to [0045], FIGS. 4 and 5) is known as a technology for adjusting positional displacement of an image to be formed on a medium.

With the technology described in Japanese Unexamined Patent Application Publication No. 2012-141396, the rotational position of a photoconductor is detected by detecting a detection mark on a photoconductor, which is an example of an image carrier; and the position of an image to be formed on a photoconductor is adjusted by using the difference between the timing at which the detection mark is detected and the timing at which a pattern image formed on the photoconductor is detected.

SUMMARY

Aspects of non-limiting embodiments of the present disclosure relate to correction of positional displacement between an image and a medium in an image forming apparatus that is not capable of freely adjusting the transport velocity of the medium relative to the rotational velocity of an image carrier.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image carrier that is capable of holding an image on a surface thereof while rotating, an image forming unit that forms the image on the image carrier, a transfer unit that transfers the image from the image carrier to a medium while rotating, a transport unit that circulates as the transfer unit rotates and that transports the medium to a transfer region while holding the medium, and a control unit that changes a timing at which the image forming unit forms the image in accordance with variation in a ratio of a rotation velocity of the transfer unit to a rotation velocity of the image carrier.

BRIEF DESCRIPTION OF THE DRAWINGS

Exemplary embodiments of the present disclosure will be described in detail based on the following figures, wherein.

DETAILED DESCRIPTION

Figure 1:
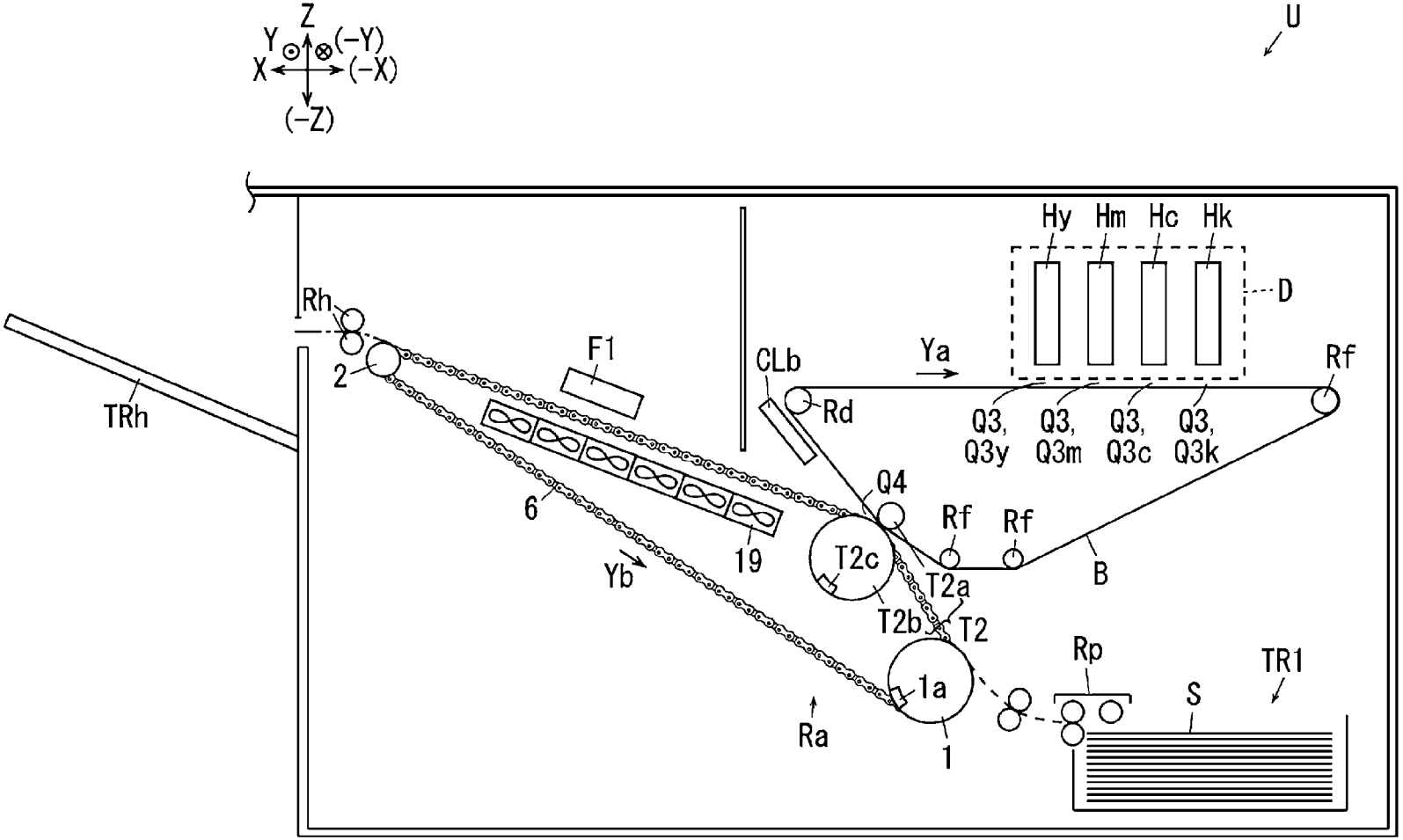
FIG. 1 illustrates an image forming apparatus according to a first exemplary embodiment of the present disclosure.

Referring to the drawings, specific examples of exemplary embodiments of the present disclosure (hereafter, referred to as "exemplary embodiments") will be described. However, the present disclosure is not limited to the exemplary embodiments described below.

For ease of understanding the following description, in the drawings, the front-back direction is defined as the X-axis direction, the left-right direction is defined as the Y-axis direction, the up-down direction is defined as the Z-axis direction; and the directions or sides indicated by arrows X, −X, Y, −Y, Z, and −Z are respectively defined as forward, backward, rightward, leftward, upward, and downward, or as the front side, the back side, the right side, the left side, the upper side, and the lower side.

In each figure, "O" with "." in it represents an arrow extending from the back side toward the front side of the plane of the figure, and "O" with "x" in it represents an arrow extending from the front side toward the back side of the plane of the figure.

In the following description with reference to the drawings, for ease of understanding, members that are not necessary for the description are omitted as appropriate.

First Exemplary Embodiment

FIG. 1 illustrates an image forming apparatus according to a first exemplary embodiment of the present disclosure.

Referring to FIG. 1, an inkjet printer U, which is an example of an image forming apparatus according to the present disclosure, includes an image-forming section D, which is an example of an image forming unit. The image-forming section D includes a head Hy, for a color Y (yellow), that ejects an ink in response to an image signal for the color Y. The image-forming section D further includes heads Hm, Hc, and Hk that respectively eject inks in response to image signals of a color M (magenta), a color C (cyan), and a color K (black).

An image forming timing of the image-forming section D and a power supply timing of an electric power circuit (not shown) are controlled in accordance with control signals from a controller C (FIG. 3), which is an example of a control unit. When print information is input from a personal computer (not shown), which is an example of an information processing apparatus connected to the printer U, the controller C according to the first exemplary embodiment converts the print information into image signals of Y, M, C, and K and outputs control signals to the image-forming section D.

An intermediate transfer belt B, which is an example of an image carrier, is disposed below the image-forming section D. The intermediate transfer belt B is supported by plural support units including a driving roller Rd, which is an example of a driving unit, a backup roller T2*a*, which is an example of a facing unit, and a driven roller Rf, which is an example of a driven unit. To the driving roller Rd, driving power of a motor (not shown), which is an example of driving unit, is transmitted. The intermediate transfer belt B is rotated in a rotation direction Ya as the driving roller Rd rotates.

The heads Hy, Hm, Hc, and Hk are arranged in such a way that ink ejection surfaces thereof face the surface of the intermediate transfer belt B and so that the heads Hy, Hm, Hc, and Hk are arranged at intervals in the rotation direction Ya of the intermediate transfer belt B. The intermediate transfer belt B is capable of holding, on the surface thereof, images that are composed of color inks respectively ejected from the heads Hy to Hk toward the intermediate transfer belt B.

A belt cleaner CLb, which is an example of a cleaning unit, is disposed downstream of a transfer region Q4 in the rotation direction Ya of the intermediate transfer belt B. The belt cleaner CLb removes residual substances that adhere to the surface of the intermediate transfer belt B after the intermediate transfer belt B has passed the transfer region Q4.

The inkjet image forming apparatus including such an intermediate transfer belt is known and is described, for example, in Japanese Unexamined Patent Application Publication No. 2000-127359, Japanese Unexamined Patent Application Publication No. 2020-97239, Japanese Unexamined Patent Application Publication No. 2020-97643, and the like. Therefore, a detailed description of the inkjet image forming apparatus will be omitted.

A sheet-feed tray TR1, which is an example of an accommodation unit, is disposed in a lower part of the printer U. A sheet S, which is an example of a medium, is accommodated in the sheet-feed tray TR1.

The sheet S in the sheet-feed tray TR1 is fed by a feed roller Rp, which is an example of a sheet feed unit, and is transported by a chain gripper Ra, which is an example of a transport unit, toward the transfer region Q4.

A transfer drum T2*b*, which is an example of a transfer member, is disposed below the backup roller T2*a*. The transfer region Q4 is a region between the transfer drum T2*b* and the backup roller T2*a*. At the transfer region Q4, the sheet S and the intermediate transfer belt B come into contact with each other while being pressed by the transfer drum T2*b* and the backup roller T2*a*, and an image formed on the surface of the intermediate transfer belt B is transferred to the sheet S. The backup roller T2*a* and the transfer drum T2*b* constitute a transfer device T2, which is an example of a transfer unit according to the first exemplary embodiment.

The sheet S that has passed the transfer region Q4 is transported to a light irradiation device F1, which is an example of a fixing unit. The light irradiation device F1 irradiates the surface of the sheet S with an electromagnetic wave that cures ink on the surface. As the electromagnetic wave, an electron beam, ultraviolet (UV) radiation, infrared radiation, and the like may be used in accordance with the types of inks used. Accordingly, the light irradiation device F1 fixes an image to the sheet S by curing the ink.

The sheet S that has passed the light irradiation device F1 is transported to an output tray TRh, which is an example of a stacking unit, and is stacked on the output tray TRh.

Description of Transport Unit

Figure 2:
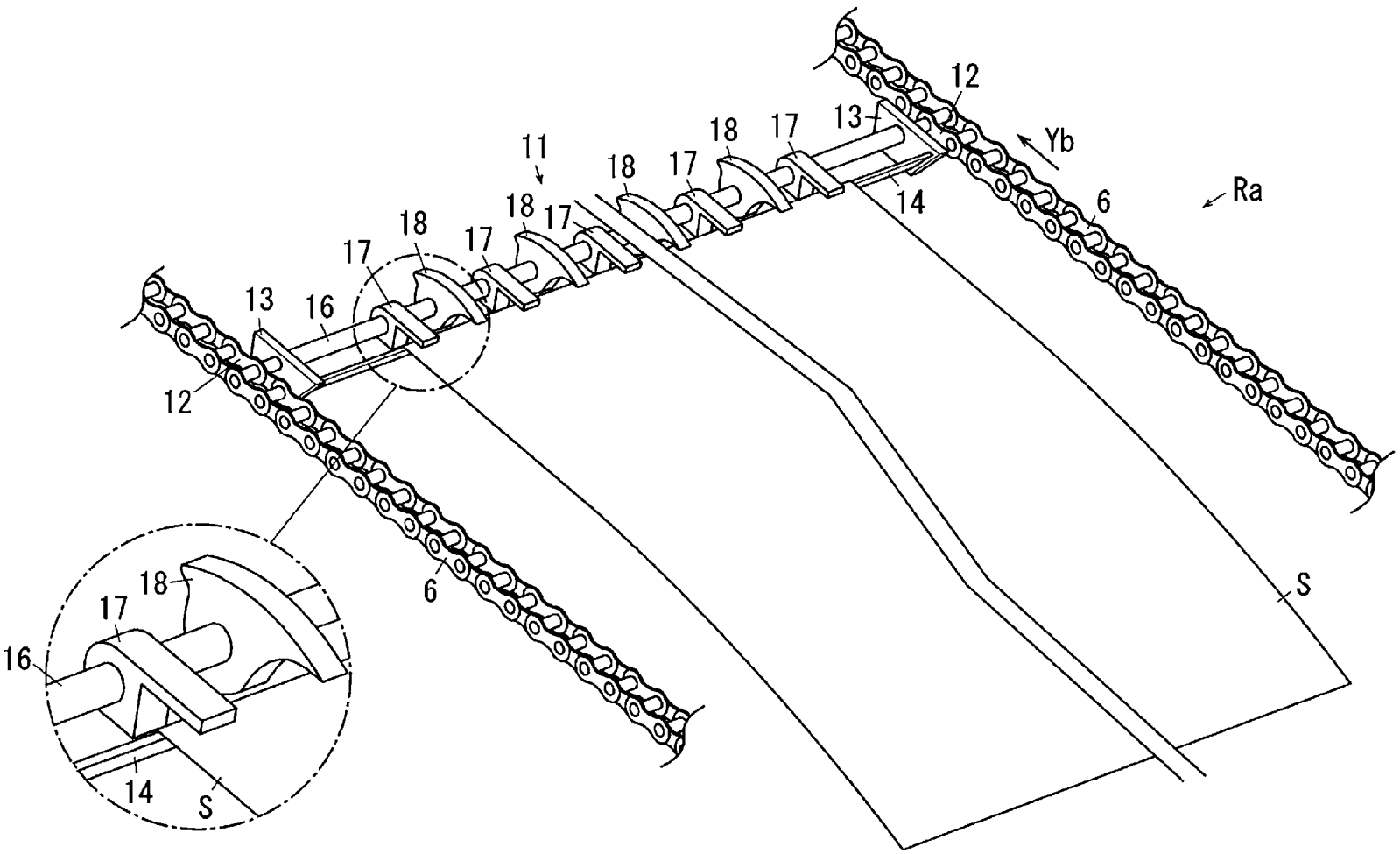
FIG. 2 illustrates a transport unit according to the first exemplary embodiment.

FIG. 2 illustrates a transport unit according to the first exemplary embodiment.

The chain gripper Ra according to the first exemplary embodiment includes a mount drum 1 (FIG. 1), which is an example of a mount unit, and a driven shaft 2 (FIG. 1). The mount drum 1 is disposed upstream of the transfer drum T2*b* with respect to the transport direction of the sheet S. The mount drum 1 according to the first exemplary embodiment is a cylindrical member that extends in the left-right direction and that has an accommodation portion 1*a* (FIG. 1), which has a recessed shape and extends in the left-right direction, in a part thereof in the circumferential direction. The accommodation portion 1*a* is configured to be capable of accommodating a gripper 11 (described below).

The transfer drum T2*b* also has an accommodation portion T2*c* (FIG. 1), which is similar to the accommodation portion 1*a*. The transfer drum T2*b* according to the first exemplary embodiment is made of a material such that the rigidity of the backup roller T2*a* is higher than that of the transfer drum T2*b*. For example, the transfer drum T2*b* may be basically made of a urethane rubber, and the backup roller T2*a* may be basically made of a stainless steel. The transfer drum T2*b* is pressed against the intermediate transfer belt B and the backup roller T2*a* with a predetermined contact pressure. Thus, the transfer drum T2*b* becomes elastically deformed at the transfer region Q4, where the transfer drum T2*b* and the intermediate transfer belt B face and contact each other. In the first exemplary embodiment, the radius of the transfer drum T2*b* is sufficiently larger than the radius of the backup roller T2*a*. In the first exemplary embodiment, the transfer drum T2*b* is driven by a motor M1 (FIG. 3), and the backup roller T2*a* is rotated by the transfer drum T2*b*. Accordingly, the rotational torque and the driving force of the transfer drum T2*b* are greater than those of the backup roller T2*a*.

The driven shaft 2 is disposed downstream of the light irradiation device F1 with respect to the transport direction of the sheet S. The mount drum 1 and the driven shaft 2 are rotatably supported.

The chain gripper Ra according to the first exemplary embodiment includes a pair of chains 6, each of which is an example of a circulating unit. The chains 6 are disposed on the left and right sides. The chains 6 according to the first exemplary embodiment are endless chains that pass the mount drum 1, the transfer drum T2*b*, and the driven shaft 2 in order and return to the position of the mount drum 1. The chains 6 are supported by sprockets (not shown), which are examples of gears, that are supported at both end portions of rotary shafts of the mount drum 1, the transfer drum T2*b*, and the driven shaft 2 in the axial direction.

In the first exemplary embodiment, driving power of a motor (not shown), which is an example of a driving source, is transmitted to the transfer drum T2*b*. Accordingly, the chains 6 rotate in a circulation direction Yb as the transfer drum T2*b* rotates.

Plural grippers 11, each of which is an example of a gripping unit, is supported by the chains 6. The grippers 11 are arranged at intervals in the circulation direction of the chains 6. In the first exemplary embodiment, the interval between the grippers 11, the diameter of the mount drum 1, the diameter of the transfer drum T2*b*, and the distance between the mount drum 1 and the transfer drum T2*b* are set so that each of the grippers 11 can be accommodated in the accommodation portions 1*a* and T2*c* when the gripper 11 reaches the position of the mount drum 1 and the transfer drum T2*b*.

Each gripper 11 includes a pair of left and right support plates 13, each of which is an example of a support unit, that are supported by plates 12 inside of the chains 6.

A plate portion 14, which is an example of a first gripping portion, is supported between the support plates 13. The plate portion 14 according to the first exemplary embodiment has a plate-like shape extending in the left-right direction.

A rotary shaft 16, which extends through the support plates 13 in the left-right direction, is rotatably supported by the support plates 13. Outer ends of the rotary shaft 16 extend to the outside of the chains 6. A cam (not shown), which is an example of a transmitted member, is supported by an outer end portion of the rotary shaft 16.

Plural contact portions 17, each of which is an example of a second gripping portion, are supported by the rotary shaft 16. The contact portions 17 are disposed at intervals in the left-right direction.

On the rotary shaft 16, spacers 18, each of which is an example of a spacing member, are disposed between the contact portions 17. Each spacer 18 has an outer surface having an arc shape along the outer peripheral surfaces of the mount drum 1 and the transfer drum T2*b*. That is, when each gripper 11 is accommodated in the accommodation portion 1*a*, the outer surfaces of the spacers 18 compensate for a part lacking in the circumference of the mount drum 1 corresponding to the accommodation portion 1*a*.

Referring to FIG. 1, plural fans 19, each of which is an example of a floating unit that floats the sheet S passing above the fans 19 by blowing air from below, are disposed between the transfer drum T2*b* and the driven shaft 2. In the first exemplary embodiment, the sheet S is transported while being floated by the fans 19. Instead, a guide plate, which is an example of a guide unit, a rotating transfer belt, and the like may be disposed. Also in this case, transportation of the sheet S is performed by the gripper 11.

Function of Chain Gripper Ra

Each gripper 11 according to the first exemplary embodiment moves in the circulation direction Yb of the chain 6 as the chain 6 circulates. The gripper 11 according to the first exemplary embodiment is configured so that the cam of the rotary shaft 16 is guided along a guide groove (not shown) that extends in the circulation direction Yb of the chain 6. The guide groove is configured to rotate the cam to move the contact portions 17 closer to the plate portion 14 when the gripper 11 passes the position of the mount drum 1, and to rotate the cam in the opposite direction to move the contact portions 17 away from the plate portion 14 when the gripper 11 passes the position of the driven shaft 2.

Accordingly, the sheet S is transported as follows in the first exemplary embodiment. First, the feed roller Rp transports the sheet S in synchronism with the timing at which the gripper 11 moves to the position of the mount drum 1. Then, the gripper 11 grips the front end of the sheet S between the contact portions 17 and the plate portion 14. Then, as the chain 6 circulates, the gripper 11 moves to feed the sheet S to the position of the transfer region Q4 and to the position of the light irradiation device F1. Then, after the sheet S has passed the light irradiation device F1, the contact portions 17 and the plate portion 14 separate from each other to release the front end of the sheet S, and an output roller Rh transports the sheet S to the output tray TRh.

Description of Controller According to First Exemplary Embodiment

Figure 3:
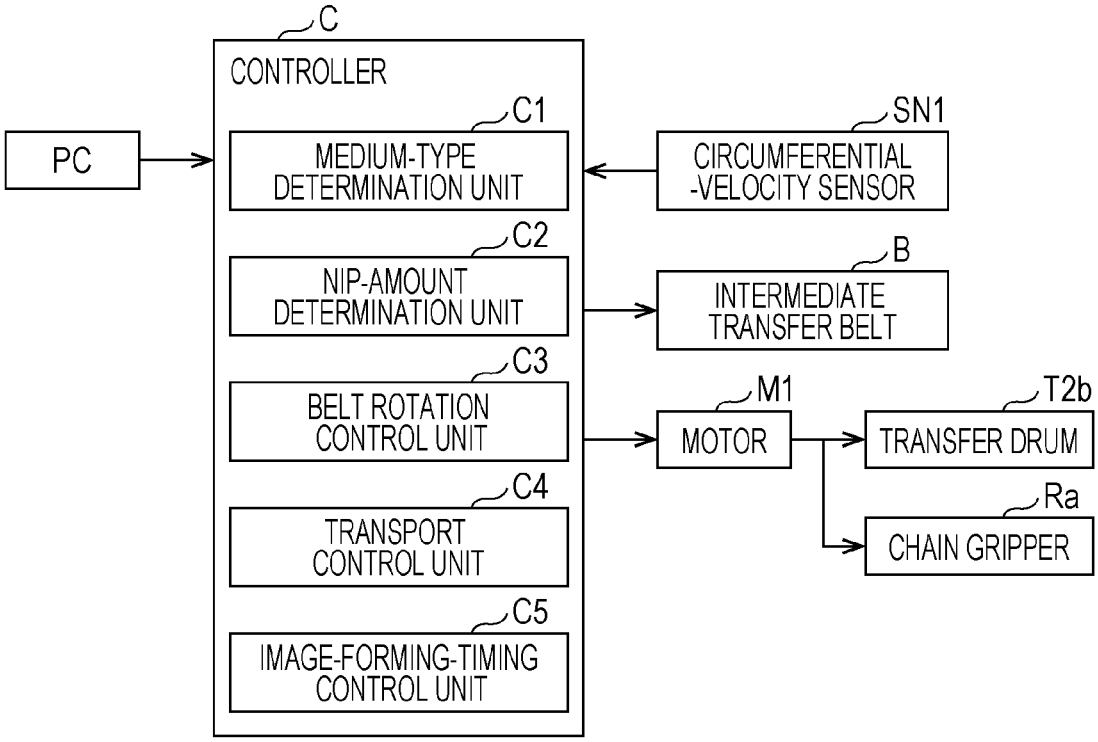
FIG. 3 illustrates a controller according to the first exemplary embodiment.

FIG. 3 illustrates a controller C according to the first exemplary embodiment.

Referring to FIG. 3, the controller C, which is an example of a control unit of the printer U, includes an input-output interface I/O that performs input and output of signals to and from the outside and the like. The controller C includes a read-only memory (ROM) that stores programs, information, and the like for performing necessary processing. The controller C includes a random-access memory (RAM) for temporarily storing necessary data. The controller C includes a central processing unit (CPU) that performs processing in accordance with programs stored in the ROM and the like. Accordingly, the controller C according to the first exemplary embodiment is a small information processing apparatus, that is, a so-called microcomputer. Thus, the controller C can realize various functions by executing programs stored in the ROM and the like.

Functions of Controller C

A medium-type determination unit C1 determines the type of the sheet S used. In the first exemplary embodiment, the thickness of the sheet S, which is an example of the type of the sheet S, is determined. It is possible to determine the thickness of the sheet S based on information of the sheet S used, which is included in print information. Alternatively, it is possible to determine the thickness of the sheet S based on information that is input from an operation unit of the printer U. Further alternatively, it is possible to determine the type of the sheet S by detecting the thickness of the sheet S by providing a sensor, which is an example of a detector for detecting the thickness of the sheet S, in the sheet-feed tray TR1 or in a transport path to the mount drum 1.

Figure 4A:
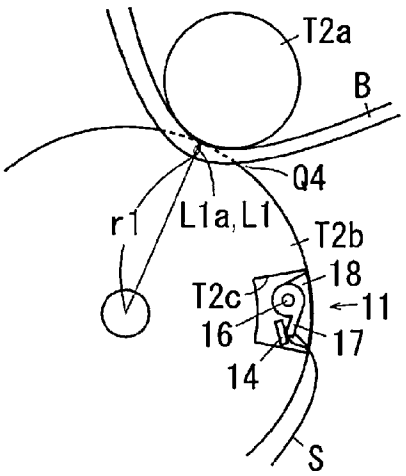
FIG. 4A illustrates a nip amount when a medium is not present.
Figure 4B:
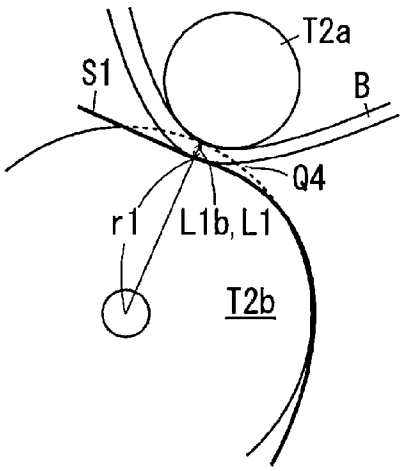
FIG. 4B illustrates a nip amount when the medium is a thin sheet.
Figure 4C:
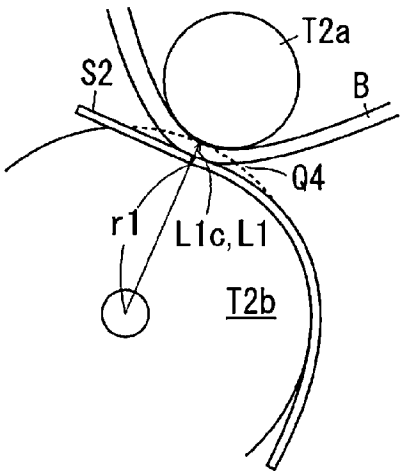
FIG. 4C illustrates a nip amount when the medium is a normal sheet.
Figure 4D:
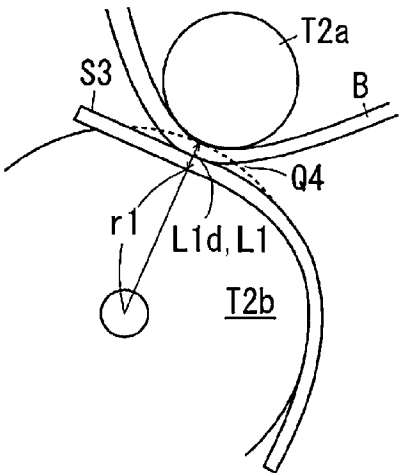
FIG. 4D illustrates a nip amount when the medium is a thick sheet.

FIG. 4A illustrates a nip amount when a medium is not present, FIG. 4B illustrates a nip amount when the medium is a thin sheet, FIG. 4C illustrates a nip amount when the medium is a normal sheet, and FIG. 4D illustrates a nip amount when the medium is a thick sheet.

A nip-amount determination unit C2 determines a nip amount L1, which is an amount by which the intermediate transfer belt B nips into the transfer unit in accordance with the thickness of the sheet S. Referring to FIG. 4A, in the transfer region Q4, the transfer drum T2*b* has a nip amount Lia even when the sheet S is not present. When the sheet S enters the transfer region Q4, the nip amount L1 of the transfer drum T2*b* increases by the amount of the thickness of the sheet S. The greater the thickness of the sheet S used, the greater is the nip amount L1. That is, a nip amount L1*c* in the case of a normal sheet S2 is greater than a nip amount L1*b* in the case of a thin sheet S1, and a nip amount L1*d* in the case of a thick sheet S3 is greater than the nip amount L1*c* in the case of the normal sheet S2.

A belt rotation control unit C3, which is an example of an image-holding-unit rotation control unit, controls rotation of the intermediate transfer belt B. The belt rotation control unit C3 according to the first exemplary embodiment rotates the intermediate transfer belt B with a predetermined rotation velocity (predetermined velocity) as an image forming operation is performed. In the first exemplary embodiment, the rotation velocity of the intermediate transfer belt B is constant irrespective of the type of the sheet S. However, the rotation velocity is not limited to this. For example, the printer U may have plural modes including: a normal-sheet mode in which the controller C controls the rotation velocity of the intermediate transfer belt B to be constant when the sheet S used is a normal sheet; and a thick-sheet mode in which the controller C reduces overall velocity, compared with the normal sheet mode, when the sheet S is a thick sheet. In this case, the rotation velocity of the intermediate transfer belt B may be a predetermined low velocity in accordance with the type of the sheet S.

A transport control unit C4 controls the chain gripper Ra. The transport control unit C4 according to the first exemplary embodiment controls rotation of the transfer drum T2*b* to control the movement velocity of each of the chains 6 and the gripper 11, that is, the transport velocity of the sheet S. In particular, the transport control unit C4 according to the first exemplary embodiment controls rotation of the transfer drum T2*b* so that the transport velocity of the sheet S at the transfer region Q4, that is, the surface velocity of the transfer drum T2*b* corresponds to the rotation velocity (surface velocity, circumferential velocity) of the intermediate transfer belt B. In the first exemplary embodiment, the surface velocity of the intermediate transfer belt B is detected by using a circumferential-velocity sensor SN1, the motor M1 of the transfer drum T2*b* is controlled, and the circumferential velocity of the transfer drum T2*b* is controlled. The circumferential-velocity sensor SN1 may use any of appropriate existing methods, such as the following, for detecting the circumferential direction: a circular plate having slits (encoder) is attached to the rotary shaft of the driven roller and the slits are detected by using the circumferential-velocity sensor SN1 such as an optical sensor to detect the circumferential velocity from the intervals at which the slit are detected; marks are formed at an end of the intermediate transfer belt B in the width direction, and the marks are detected by using the circumferential-velocity sensor SN1 such as a camera to detect the circumferential velocity from the intervals at which the marks are detected; and a protrusion that rotates together with the rotary shaft of the transfer drum T2*b* is provided on the rotary shaft, and passing of the protrusion is detected by using a sensor to detect the circumferential velocity.

Referring to FIGS. 4A to 4D, as the nip amount L1 of the transfer drum T2*b* increases, a radius r1 from the center of the transfer drum T2*b* to the outer surface of the transfer drum T2*b* decreases. Thus, as the nip amount L1 increases, the circumferential velocity (=radius×angular velocity) decreases. Accordingly, in the first exemplary embodiment, as the nip amount L1 increases, the angular velocity, that is, the rotation velocity of the motor M1 is increased so that the surface velocity of the transfer drum T2*b* in the transfer region Q4 corresponds to the surface velocity of the intermediate transfer belt B.

An image-forming-timing control unit C5 controls an image forming timing in accordance with variation in a transport velocity of the sheet S. The image-forming-timing control unit C5 according to the first exemplary embodiment controls the image forming timing in accordance with variation in the rotation velocity of the transfer drum T2*b* relative to the rotation velocity of the intermediate transfer belt B. In the first exemplary embodiment, for example, whether or not the ratio of the rotation velocity of the transfer drum T2*b* to the rotation velocity of the intermediate transfer belt B is in a predetermined range is determined to determine the variation in the ratio between the rotation velocities, and the image forming timing is controlled. The image-forming-timing control unit C5 according to the first exemplary embodiment controls the image-forming section D so that the ratio of the rotation velocity of the transfer drum T2*b* to the rotation velocity of the intermediate transfer belt B decreases as the angular velocity of the transfer drum T2*b*, that is, the rotation velocity of the motor M1 decreases and the image forming timing is delayed further as the ratio is smaller compared with a case where the ratio is higher. That is, the image-forming section D is controlled so that the image forming timing is delayed further as the thickness of the sheet S decreases (the nip amount decreases).

In the first exemplary embodiment, the timing at which each of the heads Hy to Hk ejects ink is controlled as the image forming timing. A parameter used to control the image-forming section D is not limited to the ratio between the rotation velocities. For example, the image-forming section D may be controlled, for example, in such a way that the image forming timing is delayed further as the angular velocity of the transfer drum T2*b*, that is, the rotation velocity of the motor M1 decreases, compared with a case where the angular velocity is high. Further alternatively, instead of the ratio between the rotation velocities, the difference between the rotation velocity of the intermediate transfer belt B and the rotation velocity of the transfer drum T2*b* may be used as a parameter.

Description of Flowchart According to First Exemplary Embodiment

Next, the flow of control of the printer U according to the first exemplary embodiment will be described with reference to a flowchart.

Figure 5:
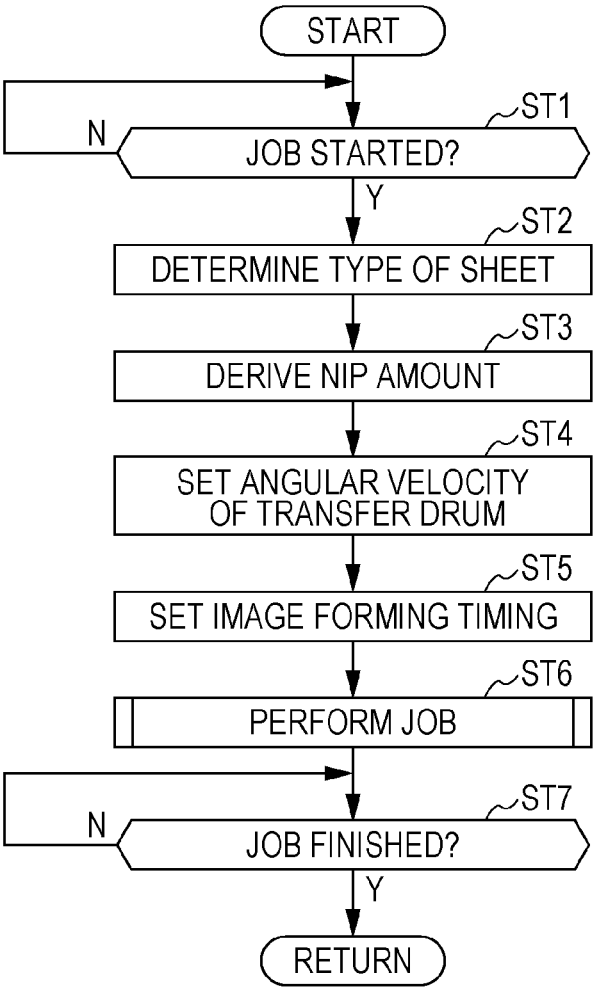
FIG. 5 is a flowchart of a process of adjusting an image forming timing according to the first exemplary embodiment.

FIG. 5 is a flowchart of the process of adjusting the image forming timing according to the first exemplary embodiment.

Processing of the steps ST of the flowchart of FIG. 5 is performed in accordance with a program stored in the controller C. The processing is performed in parallel with other processing operations of the printer U.

The flowchart illustrated in FIG. 5 is started when the power of the printer U is turned on.

In step ST1 of FIG. 5, the controller C determines whether or not the printer U has received print information and started a job. If the determination is yes (Y), the process proceeds to step ST2. If the determination is no (N), step ST1 is repeated.

In step ST2, the controller C determines the type of the sheet S. Then, the process proceeds to step ST3.

In step ST3, the controller C derives the nip amount L1 in accordance with the thickness of the sheet S. Then, the process proceeds to step ST4.

In step ST4, the controller C sets the angular velocity of the transfer drum T2*b*, that is, the rotation velocity of the motor M1 in accordance with the thickness of the sheet S. Then, the process proceeds to step ST5.

In step ST5, the controller C sets the image forming timing of the image-forming section D in accordance with the angular velocity of the transfer drum T2*b*. Then, the process proceeds to step ST6.

In step ST6, the controller C performs a job, which is an image forming operation, based on the settings of the angular velocity and the image forming timing. Then, the process proceeds to step ST7.

In step ST7, the controller C determines whether or not the job has been finished. If the determination is no (N), step ST7 is repeated. If the determination is yes (Y), the process returns to step ST1.

Operational Effects of First Exemplary Embodiment

Figure 6A:
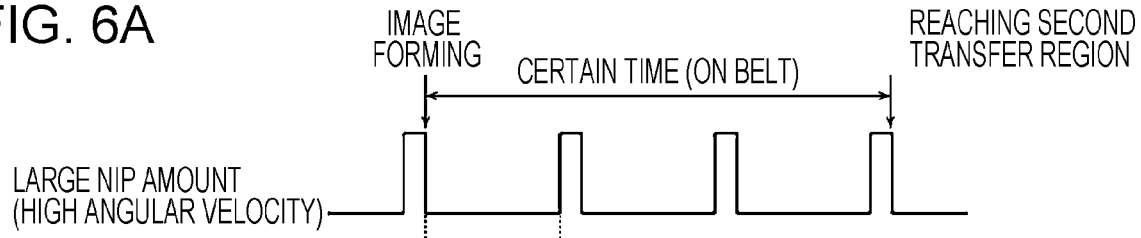
FIG. 6A illustrates intervals at which a medium reaches a second transfer region when the medium is a thick sheet.
Figure 6B:
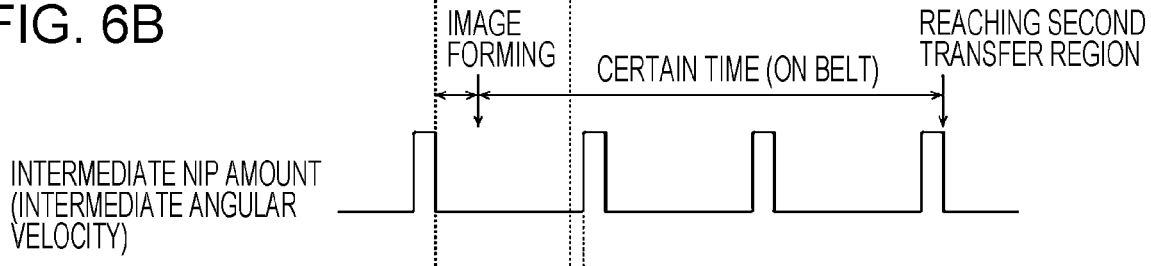
FIG. 6B illustrates the intervals when the medium is a normal sheet.
Figure 6C:
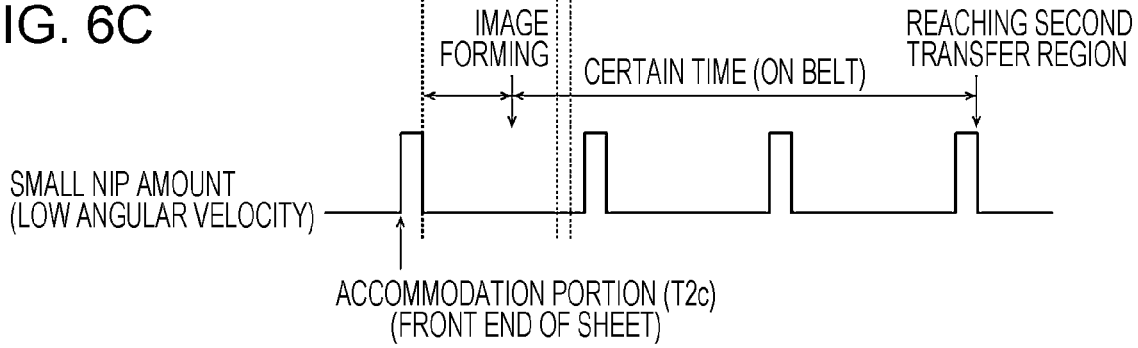
FIG. 6C illustrates the intervals when the medium is a thin sheet.

FIG. 6A illustrates intervals at which a medium reaches a second transfer region when the medium is a thick sheet, FIG. 6B illustrates the intervals when the medium is a normal sheet, and FIG. 6C illustrates the intervals when the medium is a thin sheet.

In the printer U according to the first exemplary embodiment having the configuration described above, the angular velocity of the transfer drum T2*b* is set in accordance with the thickness of the sheet S, and the image forming timing is set. Here, the circulation velocity of the intermediate transfer belt B is set to be constant in the first exemplary embodiment, because a formed image would be extended or contracted if the circulation velocity of the intermediate transfer belt B varies. On the other hand, the rotation velocity of the motor M1 of the transfer drum T2*b* varies in accordance with the thickness of the sheet S used. When the rotation velocity of the transfer drum T2*b* varies, the transfer drum T2*b* may function as rotational resistance (so-called a brake) to the intermediate transfer belt B, and the rotation velocity of the intermediate transfer belt B may vary. Thus, the motor M1 is controlled to adjust the rotation velocity of the transfer drum T2*b* so that the transfer drum T2*b* would not function as rotational resistance to the intermediate transfer belt B. When the rotation velocity of the motor M1 varies, the movement velocity (circulation velocity) of the chains 6 and the gripper 11, which are driven by the sprockets that are coaxial with the transfer drum T2*b*, also varies.

Accordingly, as illustrated in FIGS. 6A to 6C, in a case of a thick sheet (a case where the angular velocity is high), the circulation velocity of the gripper 11 is high, the transport velocity of sheet S is high, the time at which the sheet S reaches the second transfer region is early, and the interval between the sheets S is small. On the other hand, in a case of a thin sheet (a case where the angular velocity is low), the circulation velocity of the gripper 11 is low, the transport velocity of sheet S is low, the time when the sheet S reaches the second transfer region is late, and the interval between the sheets S is large.

Accordingly, in the first exemplary embodiment, although the time for which an image moves from an image-forming position Q3 (Q3*y*, Q3*m*, Q3*c*, Q3*k*), where the heads Hy to Hk form the image on the intermediate transfer belt B, to the transfer region Q4 is constant, the time for which the sheet S, which is gripped by the gripper 11 at the mount drum 1, moves to the transfer region Q4 varies. Thus, with existing technology in which the image forming timing is constant, a position to which an image is transferred to the sheet S may become displaced.

In contrast, with the first exemplary embodiment, the angular velocity of the transfer drum T2*b* is set so that the transport velocity of the sheet S corresponds to the rotation velocity of the intermediate transfer belt B; and although the angular velocity cannot be freely adjusted, the image forming timing is adjusted in accordance with variation in the angular velocity. Thus, displacement between the image and the sheet S is corrected.

Second Exemplary Embodiment

Figure 7:
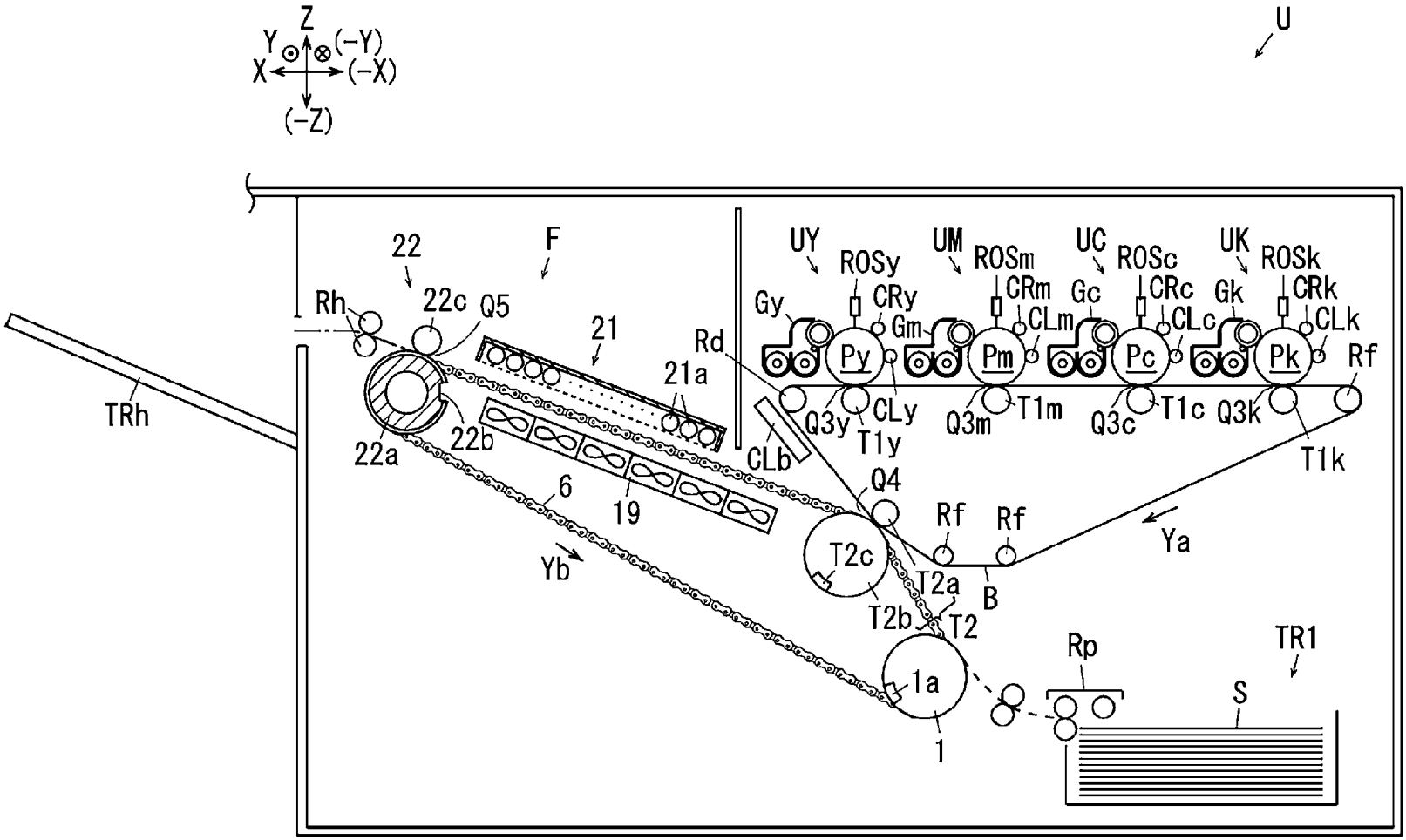
FIG. 7 illustrates an image forming apparatus according to a second exemplary embodiment.

FIG. 7 illustrates an image forming apparatus according to a second exemplary embodiment.

Next, the second exemplary embodiment of the present disclosure will be described. In the description of the second exemplary embodiment, constituent elements corresponding to those of the first exemplary embodiment will be denoted by the same reference numerals and detailed descriptions of such constituent elements will be omitted.

The second exemplary embodiment differs from the first exemplary embodiment in the following respects and is similar to the first exemplary embodiment in the other respects.

A printer U according to the second exemplary embodiment is an electrophotographic image forming apparatus, which is different from an inkjet image forming apparatus according to the first exemplary embodiment. Accordingly, the printer U includes toner image forming devices UY, UM, UC, and UK, which are an example of an image forming section, instead of the image-forming section D according to the first exemplary embodiment. The toner image forming device UY for color Y includes a photoconductor drum Py, which is an example of an image carrier; a charger CRy, which is an example of a charging unit; a writing device ROSy, which is an example of a latent image forming unit; a developing unit Gy, which is an example of a developing unit, a first-transfer unit Tly, which is an example of a first-transfer unit, and a drum cleaner CLy, which is an example of a cleaning unit. The charger CRy charges the surface of the photoconductor drum Py. The writing device ROSy forms an electrostatic latent image for color Y on the surface of the photoconductor drum Py based on print information. The developing unit Gy develops the latent image on the photoconductor drum Py into a Y-color image. The first-transfer unit Tly transfers the image held by the photoconductor drum Py to the intermediate transfer belt B. The drum cleaner CLy removes substances adhering to the surface of the photoconductor drum Py after first-transfer.

The toner image forming apparatuses UM, UC, and UK for color M, color C, and color B are each similar to the toner image forming apparatus UY for color Y.

The printer U according to the second exemplary embodiment differs from the first exemplary embodiment in that a second-transfer voltage is applied between the backup roller T2*a* and the transfer drum T2*b*. The second-transfer voltage is a voltage that allows Y-color, M-color, C-color, and B-color images, which are held on the intermediate transfer belt B, to be transferred to the sheet S. In the second exemplary embodiment, for example, a developer that has a negative polarity when charged is used, the transfer drum T2*b* is grounded, and a negative voltage is applied to the backup roller T2*a*.

In the printer U according to the second exemplary embodiment, instead of the light irradiation device F1, a fixing device F is used as an example of a fixing unit. The fixing device F according to the second exemplary embodiment includes a preheater 21 and a fixing portion 22. The preheater 21 includes plural infrared heaters 21*a* that are arranged in the transport direction of the sheet S. The infrared heaters 21*a*, each of which is an example of a heater, heats unfixed toners on the surface of the sheet S in a non-contact manner. The fixing portion 22 includes a pressing roller 22*a*, which is an example of a pressing unit and which is disposed instead the driven shaft 2. The pressing roller 22*a* has an accommodation portion 22*b*, as with the transfer drum T2*b* and the like. A heating roller 22*c*, which is an example of a heating unit, faces the pressing roller 22*a*. The heating roller 22*c* has a hollow cylindrical shape, and a heater (not shown), which is an example of a heat source, is disposed inside of the heating roller 22*c*. Accordingly, when the sheet S passes a fixing region Q5 between the pressing roller 22*a* and the heating roller 22*c*, unfixed toners on the sheet S become fixed (fully fixed) while being heated.

The controller C according to the second exemplary embodiment adjusts the image forming timing by adjusting the time when the writing devices ROSy to ROSk form latent images.

Operational Effects of Second Exemplary Embodiment

With the printer U according to the second exemplary embodiment having the configuration described above, as with the first exemplary embodiment, the intermediate transfer belt B rotates with a constant rotation velocity. Accordingly, the time for which an image written by the writing devices ROSy to ROSk reaches the transfer region Q4 is constant. On the other hand, when the angular velocity of the transfer drum T2*b* varies in accordance with the thickness of the sheet S, the timings at which the writing devices ROSy to ROSk form latent images are adjusted. Accordingly, it is possible to correct displacement of images that are to be second-transferred to the sheet S.

Modifications

The present disclosure is not limited to the exemplary embodiments in detail, and may be modified in various ways within the spirit and scope of the present disclosure described in the claims. Hereafter, modifications (H01) to (H07) of the present disclosure will be described.

(H01) In each of the exemplary embodiments, a printer is described as an example of an image forming apparatus. However, the image forming apparatus is not limited to a printer. The present disclosure is also applicable to image forming apparatuses such as a copier, a FAX, and the like. Image forming apparatuses that use four colors (Y, M, C, and K) have been described as examples. However, the number of colors is not limited to four. The present disclosure is also applicable to an image forming apparatus that uses one color, two colors, three colors, or five or more colors.

(H02) In the second exemplary embodiment, an electrophotographic image forming apparatus including the intermediate transfer belt B is described as an example. However, the image forming apparatus is not limited to this. The present disclosure is also applicable to a configuration that directly transfers an image from the photoconductor drums Py to Pk to the sheet S.

(H03) In the exemplary embodiments, the chain gripper Ra is described as an example of a transport unit. However, the transport unit is not limited to this. For example, the present disclosure is applicable to any configuration in which a transfer-transport belt that rotates while supporting the sheet S on an upper surface thereof is used and in which the transport velocity of the sheet S varies in accordance with the thickness of the sheet S or the nip amount.

(H04) In the exemplary embodiments, the thickness of the sheet S and the nip amount are described as examples of factors for varying the angular velocity of the transfer drum T2*b*. However, the factors are not limited to these. For example, the angular velocity may be varied in accordance with, for example, environmental factors such as temperature and humidity, wear due to aging degradation, variation in production, and the like. For example, when temperature is high and the nip amount increases due to the effect of thermal expansion of the transfer drum T2*b*, the angular velocity may be varied in accordance with the temperature. When humidity is high and the nip amount increases due to the effect of absorption of moisture by the transfer drum T2*b*, the angular velocity may be varied in accordance with the humidity. When the diameter of the transfer drum T2*b* decreases due to aging degradation, the angular velocity may be varied. When the nip amount differs due to variation in manufacturing, the angular velocity may be varied in accordance with the nip amount. Only the thickness of the sheet S has been described as the type of a medium. However, the type of the medium is not limited to this. For example, there is a case where the type of the medium differs as follows: some sheets are easily compressed when nipped between the backup roller T2*a* and the transfer drum T2*b*, such as a sheet in which plural materials, including paper layers, coating layers, and the like, are stacked (so-called coated sheet) or a sheet having protrusions and recesses (so-called embossed sheet); and some sheets, such as an OHP sheet, are not easily compressed compared to a normal sheet. In this case, it is possible to individually set the nip amount in the transfer region Q4 in accordance with the type of the medium and to vary the angular velocity.

(H05) In the exemplary embodiments, the nip amount L1 varies as the transfer drum T2*b* elastically deforms in accordance with the thickness of a medium used. However, a factor that varies in accordance with the type of a medium is not limited to this. For example, the present disclosure is also applicable to a configuration such that the contact pressure and the nip amount are adjusted by moving the backup roller T2*a* and the transfer drum T2*b* closer to each other or away from each other in accordance with the type of a medium used. In this case, it is desirable to vary the angular velocity additionally in consideration of a change in nip amount due to movements of the backup roller T2*a* and the transfer drum T2*b* close to each other or away from each other. For example, the present disclosure is applicable to a configuration that physically assists in movement of developer by increasing the contact pressure in a case where the developer does not easily move due to electrical resistance of the medium.

(H06) In the exemplary embodiments, as examples of the image forming timing, a timing at which the heads Hy to Hk eject inks and a timing at which the writing devices ROSy to ROSk form latent images are described. However, the image forming timing is not limited to these. Any parameter that serves as a reference for the image forming timing may be used, because the control timing of each member for forming an image and a timing at which a control signal is output are linked. For example, it is possible to use any of the following timings as a reference: a timing at which a mark formed on the intermediate transfer belt B or the photoconductor drums Py to Pk is detected; a timing at which a sensor for detecting the circumferential velocity of the transfer drum T2*b* detects a slit or a projection; a timing at which the sheet S is detected to have reached a specific position; a timing at which the chargers CRy to CRk start charging; a timing at which a voltage is applied; and the like. Accordingly, the "reference" may be a timing at which the heads Hy to Hk or the writing devices ROSy to ROSk operate or may be a timing at which the heads Hy to Hk or the writing devices ROSy to ROSk operate after a certain time has passed from the reference. That is, the "reference" refers to a guideline for starting an image forming operation.

(H07) In the exemplary embodiments, an example in which the rotation velocity of the transfer drum T2*b* is controlled in accordance with the circulation velocity of the intermediate transfer belt B is described. However, controlling of the rotation velocity of the transfer drum T2*b* is not limited to this. The rotation velocity of the transfer drum T2*b* may be controlled to be a velocity that is not the same as the circulation velocity of the intermediate transfer belt B but is within a predetermined range from the circulation velocity of the intermediate transfer belt B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier that is capable of holding an image on a surface thereof while rotating;

an image forming unit that forms the image on the image carrier;

a transfer unit that transfers the image from the image carrier to a medium while rotating;

a transport unit that circulates as the transfer unit rotates and that transports the medium to a transfer region while holding the medium; and a control unit that changes a timing at which the image forming unit forms the image in accordance with variation in a ratio of a rotation velocity of the transfer unit to a rotation velocity of the image carrier.

2. The image forming apparatus according to claim 1, wherein the transfer unit is pressed toward the image carrier, and wherein the control unit changes the rotation velocity of the transfer unit relative to the rotation velocity of the image carrier in accordance with a nip amount by which the image carrier nips into the transfer unit.

3. The image forming apparatus according to claim 2, wherein the control unit controls the transport unit so that the transport unit transports the medium with a transport velocity corresponding a circumferential velocity of the image carrier in accordance with the nip amount.

4. The image forming apparatus according to claim 2, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

5. The image forming apparatus according to claim 1, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

6. The image forming apparatus according to claim 1, wherein the transfer unit is pressed toward the image carrier, and wherein the control unit controls the timing at which the image forming unit forms the image in accordance with variation in a nip amount by which the image carrier nips into the transfer unit in accordance with a type of the medium.

7. The image forming apparatus according to claim 6, wherein the control unit controls the timing at which the image forming unit forms the image in accordance with the nip amount that varies in accordance with a thickness of the medium.

8. The image forming apparatus according to claim 7, wherein the control unit delays the timing at which the image forming unit forms the image in a case where the thickness of the medium is small compared with a case where the thickness of the medium is large.

9. The image forming apparatus according to claim 1, wherein the transfer unit is pressed toward the image carrier, and wherein the control unit controls the timing at which the image forming unit forms the image in accordance with variation in a nip amount by which the image carrier nips into the transfer unit in accordance with an installation environment in which the image forming apparatus is installed.

10. The image forming apparatus according to claim 9, wherein the control unit reduces the nip amount and delays the timing at which the image forming unit forms the image in a case where a humidity of the installation environment is lower than a predetermined value compared with a case where the humidity of the installation environment is higher than the predetermined value.

11. An image forming apparatus comprising:

an image carrier that is capable of holding an image on a surface thereof while rotating;

an image forming unit that forms the image on the image carrier;

a transfer unit that transfers the image from the image carrier to a medium while rotating;

a transport unit that circulates as the transfer unit rotates and that transports the medium to a transfer region while holding the medium; and a control unit that changes, in a mode in which the image carrier rotates with a predetermined velocity, a timing at which the image forming unit forms the image in accordance with variation in a rotation velocity of the transfer unit relative to a rotation velocity of the image carrier.

12. The image forming apparatus according to claim 11, wherein the transfer unit is pressed toward the image carrier, and wherein the control unit changes the rotation velocity of the transfer unit relative to the rotation velocity of the image carrier in accordance with a nip amount by which the image carrier nips into the transfer unit.

13. The image forming apparatus according to claim 12, wherein the control unit controls the transport unit so that the transport unit transports the medium with a transport velocity corresponding a circumferential velocity of the image carrier in accordance with the nip amount.

14. The image forming apparatus according to claim 12, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

15. The image forming apparatus according to claim 11, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

16. An image forming apparatus comprising:

an image carrier that is capable of holding an image on a surface thereof while rotating;

an image forming unit that forms the image on the image carrier;

a transfer unit that transfers the image from the image carrier to a medium;

a transport unit that transports the medium; and a control unit that varies a transport velocity with which the transport unit transports the medium in accordance with variation in a rotation velocity of the image carrier and that controls a timing at which the image forming unit forms the image in accordance with variation in the transport velocity of the medium.

17. The image forming apparatus according to claim 16, wherein the transfer unit is pressed toward the image carrier, and wherein the control unit changes the rotation velocity of the transfer unit relative to the rotation velocity of the image carrier in accordance with a nip amount by which the image carrier nips into the transfer unit.

18. The image forming apparatus according to claim 17, wherein the control unit controls the transport unit so that the transport unit transports the medium with a transport velocity corresponding a circumferential velocity of the image carrier in accordance with the nip amount.

19. The image forming apparatus according to claim 17, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

20. The image forming apparatus according to claim 16, wherein the transport unit includes a plurality of gripping units each of which is capable of gripping an end portion of the medium, the gripping units being arranged at intervals in a transport direction of the medium and movable in the transport direction of the medium, and wherein the transfer unit includes an accommodation portion that accommodates one of the gripping units that passes the transfer region where the image carrier and the transfer unit face each other.

* * * * *